US010378552B2

(12) United States Patent
Sidle

(10) Patent No.: US 10,378,552 B2
(45) Date of Patent: Aug. 13, 2019

(54) MULTIDIRECTIONAL FAN SYSTEMS AND METHODS

(71) Applicant: Toshiba International Corporation, Houston, TX (US)

(72) Inventor: Brian Charles Sidle, Cypress, TX (US)

(73) Assignee: Toshiba International Corporation, Houston, TX (US)

( * ) Notice: Subject to any disclaimer, the term of this patent is extended or adjusted under 35 U.S.C. 154(b) by 453 days.

(21) Appl. No.: 15/156,973

(22) Filed: May 17, 2016

(65) Prior Publication Data

US 2017/0335857 A1 Nov. 23, 2017

(51) Int. Cl.
*F04D 29/28* (2006.01)
*F04D 29/30* (2006.01)

(52) U.S. Cl.
CPC ..... *F04D 29/287* (2013.01); *F04D 29/281* (2013.01); *F04D 29/305* (2013.01)

(58) Field of Classification Search
CPC .... F04D 29/287; F04D 29/305; F04D 29/281; F04D 27/002
USPC ..... 416/186 A, 185, 147, 153, 205, 207
See application file for complete search history.

(56) References Cited

U.S. PATENT DOCUMENTS

| | | | |
|---|---|---|---|
| 2,149,267 A | 3/1939 | Bouvy et al. | |
| 3,406,760 A | 10/1968 | Weir | |
| 3,782,853 A | 1/1974 | Frister | |
| 4,412,783 A | 11/1983 | Barlass | |
| 4,547,126 A | 10/1985 | Jackson | |
| 4,662,819 A | 5/1987 | Lakowske et al. | |
| 2014/0154083 A1 | 6/2014 | Chelf | |

FOREIGN PATENT DOCUMENTS

| | | | |
|---|---|---|---|
| DE | 662032 A1 * | 7/1938 | ..... F04D 29/2283 |
| EP | 2149712 B1 | 5/2011 | |
| FR | 2595417 A1 * | 9/1987 | ..... F04D 29/2283 |

* cited by examiner

*Primary Examiner* — Justin D Seabe
*Assistant Examiner* — Jason Mikus
(74) *Attorney, Agent, or Firm* — Baker Botts L.L.P.

(57) ABSTRACT

In accordance with certain presently disclosed embodiments, a multidirectional fan is provided. In certain embodiments, the multidirectional fan comprises a back plate having an interior surface and a central opening; a hub located around the central opening and projecting from the interior surface of the back plate; a plurality of flexible fan blades extending radially from the hub, wherein each flexible fan blade comprises a base and a blade, and wherein the base of each flexible fan blade is attached to the hub and the interior surface of the back plate; and a plurality of fasteners located at least partially on the interior surface of the back plate, wherein each fastener secures the blade of at least one flexible fan blade to the interior surface of the back plate at a predetermined position.

20 Claims, 5 Drawing Sheets

MULTIDIRECTIONAL FAN SYSTEMS AND METHODS

TECHNICAL FIELD

Embodiments of the present disclosure relate to multidirectional fans, more particularly, systems, methods, and multidirectional fans used for cooling devices such as electric motors.

BACKGROUND

When operating a fan, such as a centrifugal fan, it is desirable to maintain airflow in a particular direction despite the direction of rotation of the fan. Fans with bidirectional motors may have blades that are oriented in the radial direction to allow for use when the fan in rotated in either the clockwise or counterclockwise direction. Radial blades, however, are not as efficient as inclined blades and may cause excess noise. Thus, it is common to affix the blades in an inclined orientation. However, in order to maintain airflow in the same direction when the direction of the motor rotation is changed, the blades must be manually adjusted to a different incline or the entire fan must be swapped with a fan having blades at a different incline. Manual adjustment of the blades often requires removing the fan from the motor shaft and/or the use of tools. Both manually adjusting the blades and swapping out the fan may cause time and/or manpower to be wasted.

SUMMARY

In accordance with the above, presently disclosed embodiments are directed to apparatuses and systems comprising a multidirectional fan and methods for using the multidirectional fan.

In certain embodiments, the multidirectional fan may comprise a back plate, a hub projecting from the back plate, a plurality of flexible fan blades extending radially from the hub and at least partially attached to back plate, and plurality of fasteners located on the back plate, with each fastener in the plurality being associated with at least one of the flexible fan blades. In certain embodiments, each flexible fan blade may comprise a base and a blade. In some embodiments, the base may be attached to the hub and the back plate, and the blade may be secured to the back plate with a fastener. In certain embodiments, each fastener may comprise one or more mounts such that the blade is capable of being secured to the back plate in a plurality of positions. In such embodiments, each mount may correspond to a different position of the blade.

In certain embodiments, the multidirectional fan may be mounted on a shaft of a device, such as a motor. In certain embodiments, the shaft may be rotated in one direction while the blades are oriented in a first position. In such embodiments, the blades may be repositioned to a second position and the shaft may be rotated in the same or opposite direction. In certain embodiments, the blades may be repositioned by moving each blade from a first mount of the fastener to a second mount of the fastener.

In certain embodiments, the systems and methods disclosed herein allow the multidirectional fan of the present disclosure to operate as a radial bidirectional fan, a clockwise unidirectional fan, and/or a counterclockwise unidirectional fan depending on the positioning of the blades.

BRIEF DESCRIPTION OF THE DRAWINGS

For a more complete understanding of the present disclosure and its features and advantages, reference is made to the following description, taken in conjunction with the accompanying drawings, in which.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of the actual implementation are described in this specification. It will of course be appreciated that in the development of any such embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of this disclosure. Furthermore, in no way should the following examples be read to limit or define the scope of the disclosure.

Figure 1:
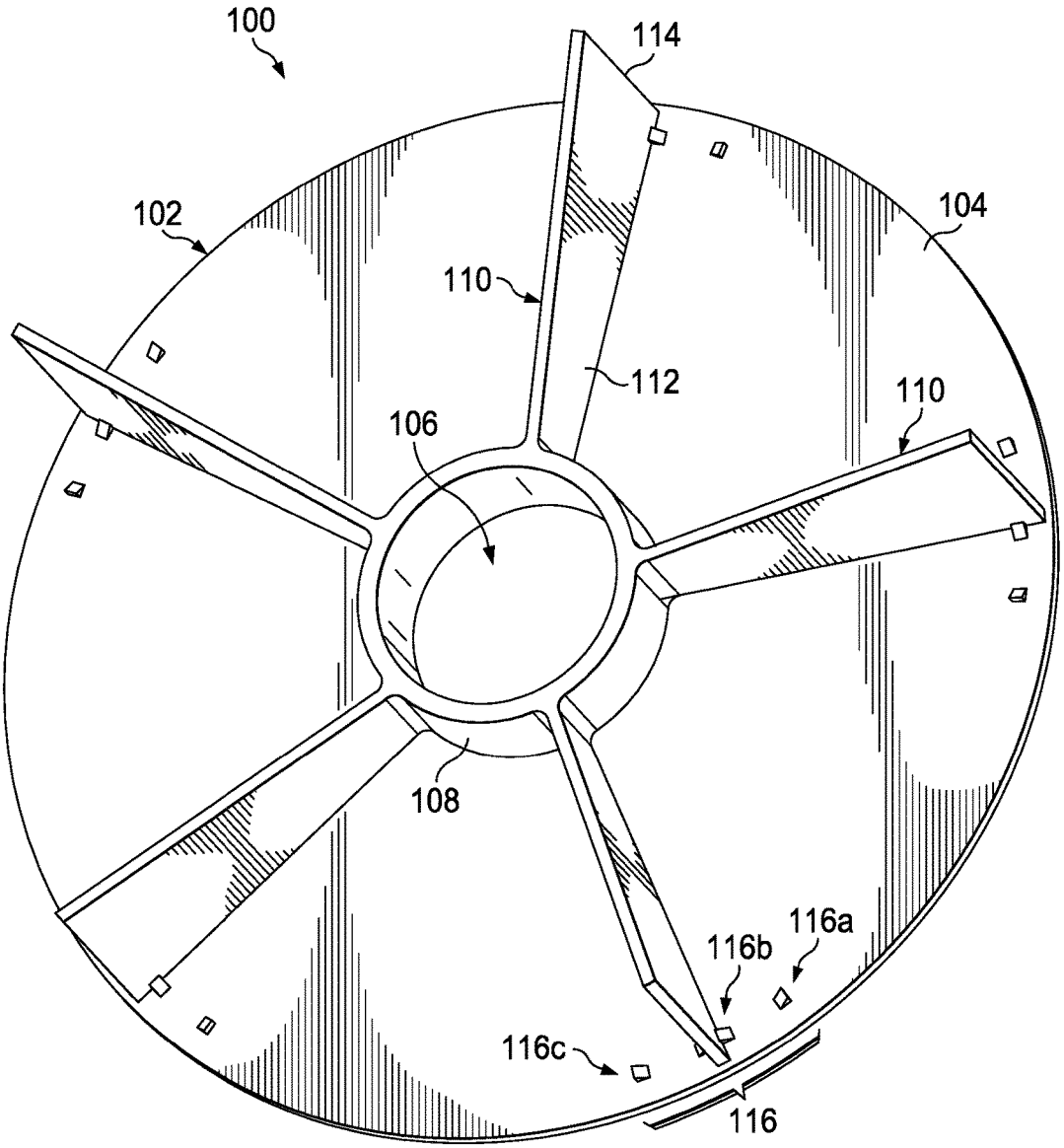
FIG. 1 is an illustrative front perspective view of a multidirectional fan having flexible fan blades in a radial bidirectional position in accordance with certain embodiments of the present disclosure.

Turning now to the drawings, FIG. 1 is an illustrative perspective view of a multidirectional fan 100 according to certain embodiments of the present disclosure. Multidirectional fan 100 comprises a back plate 102, a hub 108, a plurality of flexible fan blades 110, and a plurality of fasteners 116. In certain embodiments, back plate 102 may comprise an interior surface 104 and a central opening 106. In certain embodiments, hub 108 may be located around central opening 106 and project outwardly from interior surface 104 of back plate 102.

In certain embodiments, flexible fan blades 110 may be secured to hub 108 and may extend in a substantially radial direction from hub 108. In some embodiments, flexible fan blades 110 may be permanently attached to and/or formed integrally with hub 108. In other embodiments, flexible fan blades 110 may be removably attached to hub 108. In certain embodiments, each flexible fan blade 110 may comprise a base 112 and a blade 114. In such embodiments, base 112 may be permanently or removably attached to hub 108.

In certain embodiments, each flexible fan blade 110 may be at least partially attached to interior surface 104 of back plate 102. In some embodiments, only base 112 of flexible fan blade 110 may be attached to interior surface 104 of back plate 102 while blade 114 remains unattached. This arrangement provides that ability to adjust the position of blade 114 as further discussed herein. In such embodiments, base 112 may be permanently or removably attached to interior surface 104 of back plate 102. As will be appreciated by one having ordinary skill in the art with the benefit of the present disclosure, the portion of the flexible fan blade 110 that comprises the base 112 as compared to the blade may vary 114. In other words, the length of the flexible fan blade 110 that is secured to interior surface 104 may vary.

In certain embodiments, the fasteners 116 may be located at least partially on interior surface 104 of back plate 102. In certain embodiments, fasteners 116 may secure blades 114 of flexible fan blades 110 to interior surface 104 of back plate 102. In certain embodiments, each fastener 116 may comprise one or more mounts. As illustrated in FIG. 1, each fastener 116 comprises three mounts 116*a*, 116*b*, and 116*c*. Mounts 116*a*, 116*b*, and 116*c* may be used to secure blades 114 in multiple positions, with each mount corresponding to a different position.

Figure 2:
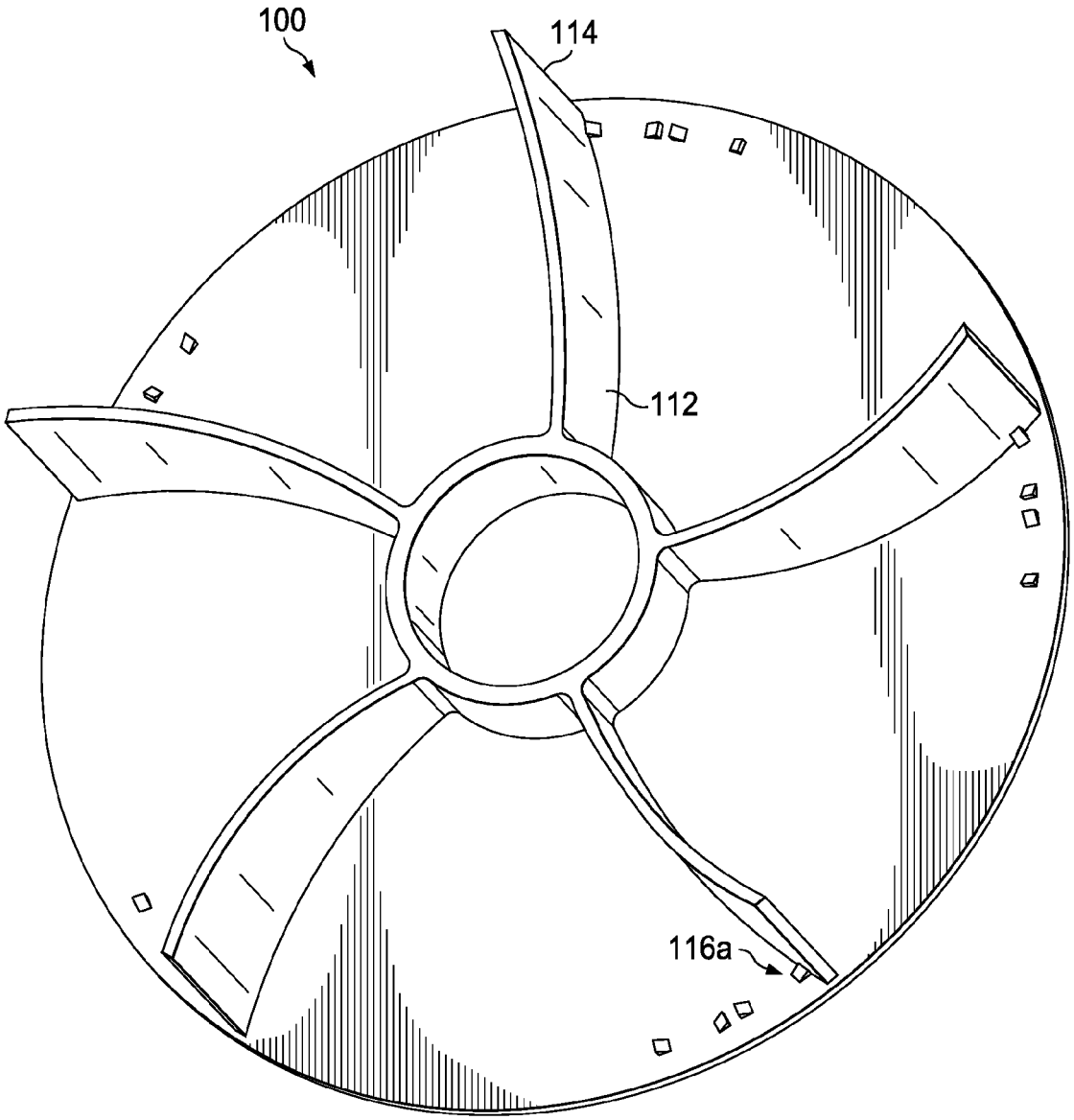
FIG. 2 is an illustrative front perspective view of a multidirectional fan having flexible fan blades in a clockwise unidirectional position in accordance with certain embodiments of the present disclosure.
Figure 3:
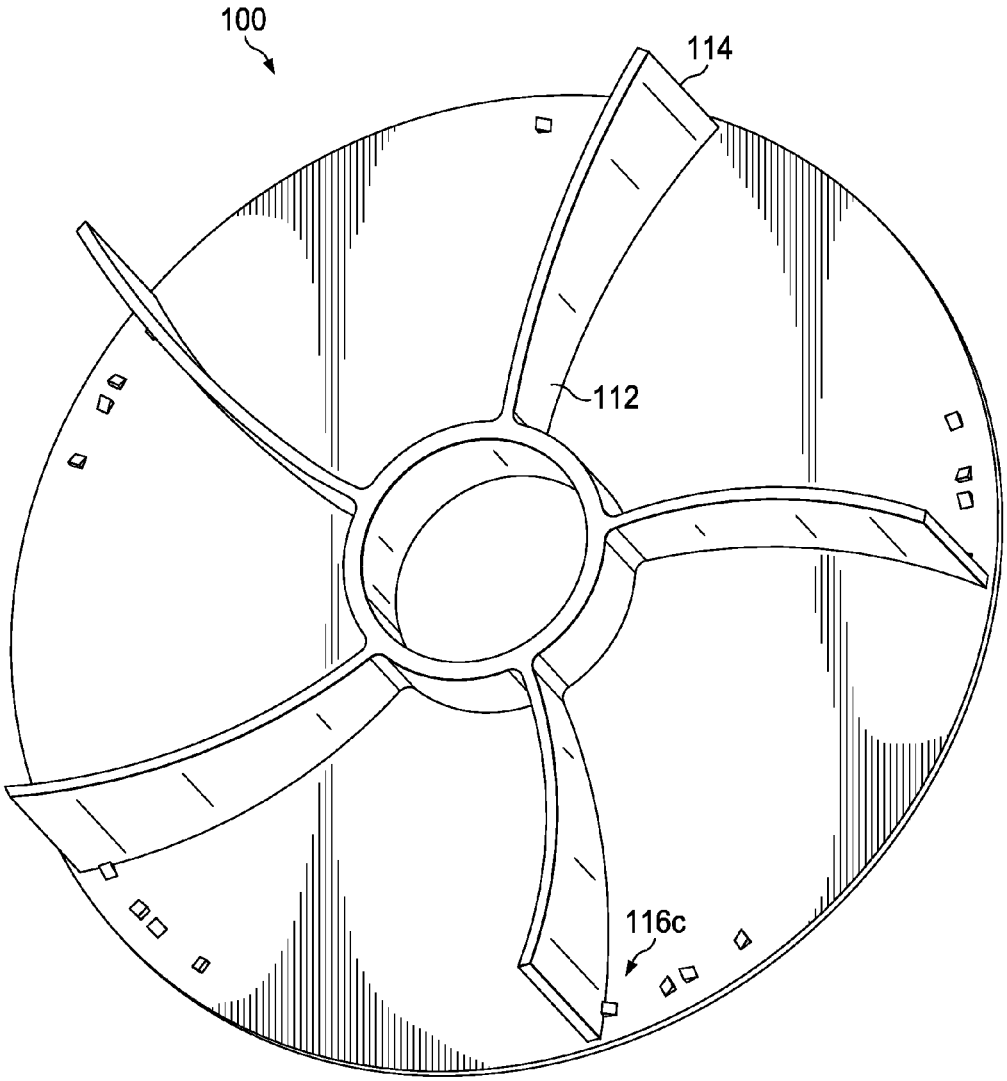
FIG. 3 is an illustrative front perspective view of a multidirectional fan having flexible fan blades in a counterclockwise unidirectional position in accordance with certain embodiments of the present disclosure.
Figure 4:
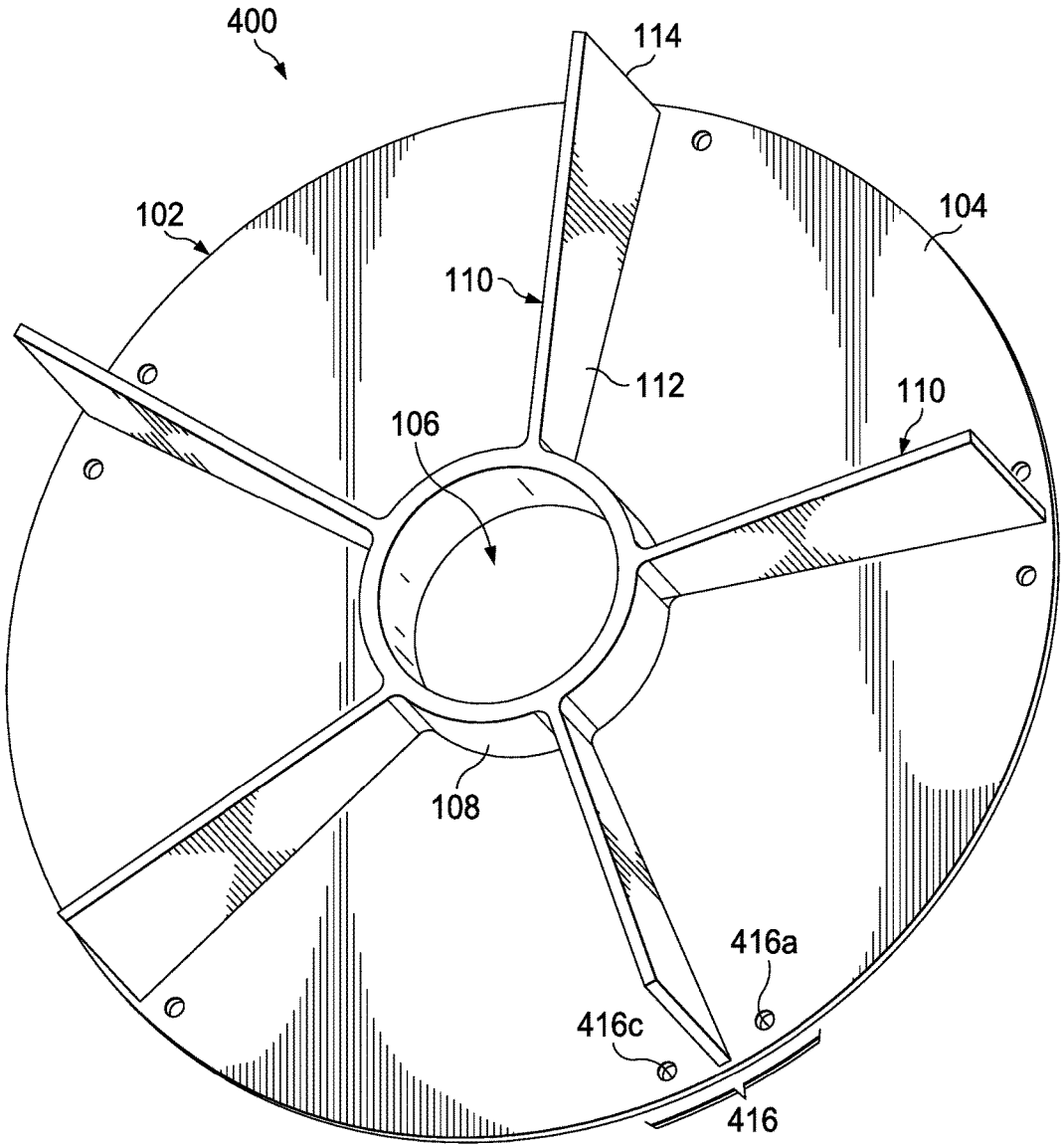
FIG. 4 is an illustrative front perspective view of a multidirectional fan having flexible fan blades in a radial bidirectional position in accordance with certain embodiments of the present disclosure.
Figure 5:
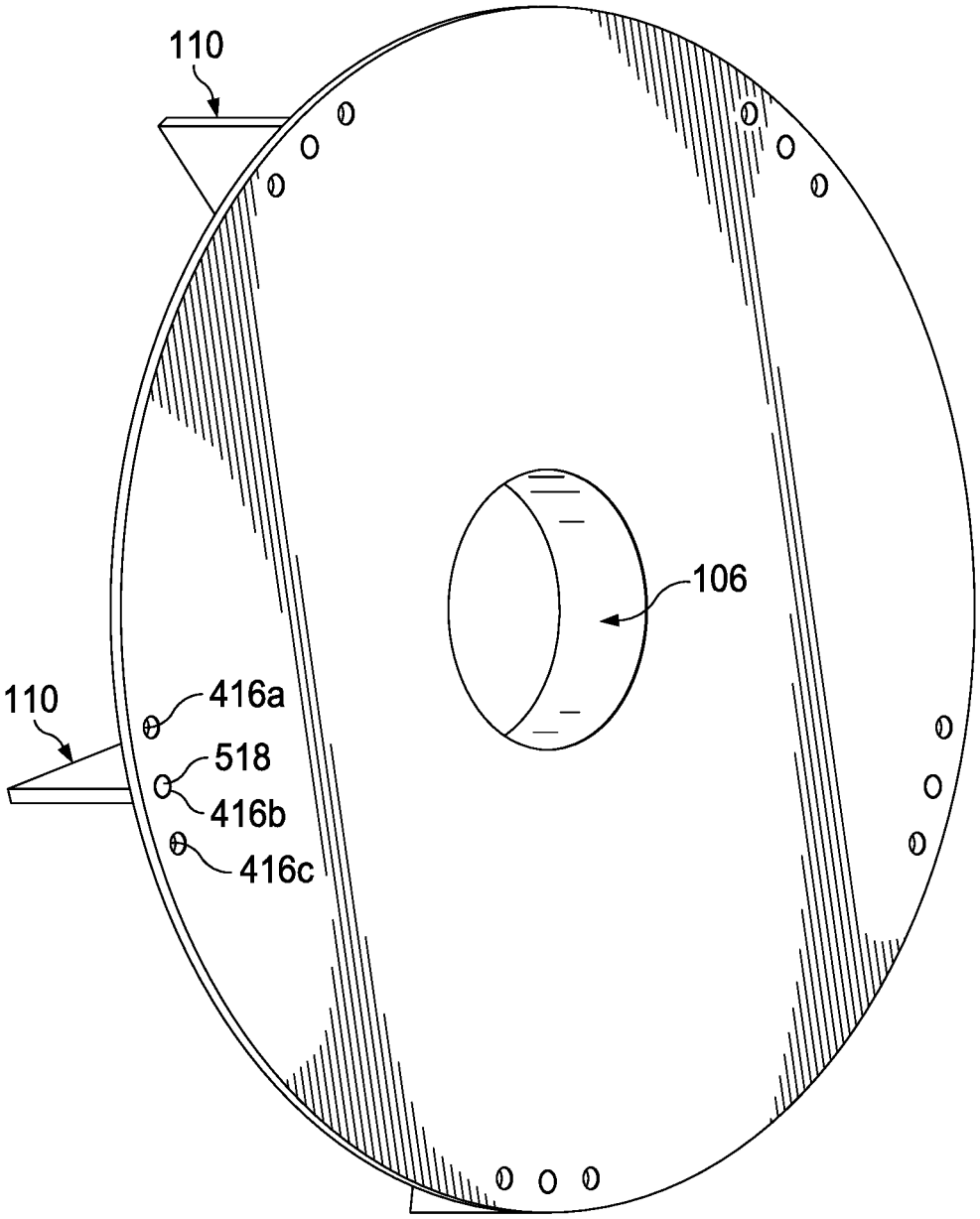
FIG. 5 is an illustrative back perspective view of a multidirectional fan having flexible fan blades in a radial bidirectional position in accordance with certain embodiments of the present disclosure.

For example, FIGS. 1-3 illustrate the same multidirectional fan 100 having blades 114 in different positions. FIG. 1 illustrates blades 114 in a radial bidirectional position. FIG. 2 illustrates blades 114 in a clockwise unidirectional position. FIG. 3 illustrates blades 114 in a counterclockwise unidirectional position. The ability to configure blades 114 in multiple different positions allows multidirectional fan 100 to be operated as a radial bidirectional fan, a clockwise unidirectional fan, and/or a counterclockwise unidirectional fan. As will be appreciated by one having ordinary skill in the art with the benefit of this disclosure, the desired operation of multidirectional fan 100 may depend on the particular application for which multidirectional fan 100 is being used and/or the direction of rotation of multidirectional fan 100.

One having ordinary skill in the art will appreciate with the benefit of this disclosure that a variety of means for removably fastening blades 114 to interior surfaces 104 of back plate 102 may be used. For example, in certain embodiments, the one or more mounts may comprise a left detent, and a central, a right detent as illustrated in FIGS. 1-3. In other embodiments, the one or more mounts may comprise one or more holes (416*a-c*) located on interior surface 104 of back plate 102. In such embodiments, fastener 116 may further comprise a peg (518) located on blade 114 of the flexible fan blade 110, and the peg (518) may be capable of being inserted into one of the holes (416*a-c*) to secure blade 114 to interior surface 104 of back plate 102.

As will be appreciated by one having ordinary skill in the art with the benefit of the present disclosure, the number of flexible fan blades 110 and/or the spacing between flexible fan blades 110 may vary. In certain embodiments, flexible fan blades 110, or at least blades 114, may comprise and/or be constructed from a flexible material that allows for the position of blades 114 to be adjusted between mounts 116*a*, 116*b*, 116*c*. In some embodiments, flexible fan blades 110, or at least blades 114, may be constructed from metal. In other embodiments, flexible fan blades 110, or at least blades 114, may be constructed from plastic, including thermoplastics such as nylon. In certain embodiments, all or some of the components of multidirectional fan 100, including back plate 102, hub 108, flexible fan blades 110, and fasteners 116, may be molded (e.g., cast) as a single unit. For example, an aluminum injection mold may be used to mold multidirectional fan 100. In embodiments in which back plate 102 and flexible fan blades 110 are molded as a single unit, the portion of flexible fan blade 110 comprising blades 114 may be attached to back plate 102 with perforations when molded or cast to allow for blades 114 to be separated from interior surface 104 of back plate 102 so that the position of blades 114 can be adjusted.

In certain embodiments, multidirectional fan 100 may be mounted on a device having a drive shaft. In such embodiments, multidirectional fan 100 may be mounted on the drive shaft using central opening 106 of back plate 102. In certain embodiments, the device having the drive shaft may comprise a motor or other electrical device capable of rotating multidirectional fan 100. The drive shaft may operate to rotate multidirectional fan 100.

Blades 114 may be positioned in a first position when multidirectional fan 100 is mounted on the drive shaft. In certain embodiments, blades 114 may be repositioned to a second position. In some embodiments, repositioning of blades 114 may comprise moving each blade 114 from a first mount, e.g., 116*b*, of the fastener 116 to a second mount, e.g., 116*a*, of the fastener 116. For example, FIG. 1 illustrates blades 114 positioned in a first position while FIG. 2 illustrates blades 114 positioned in a second position. In certain embodiments, the drive shaft may be rotated while blades 114 are in the first position, and then blades 114 may be repositioned to the second position before the drive shaft is rotated again. As will be appreciated by one having ordinary skill in the art with the benefit of the present disclosure, the desired position of the blades 114 may depend on the direction in which the drive shaft rotates.

In certain embodiments, the position of blades 114 may be adjusted or changed while multidirectional fan 100 is mounted on the drive shaft. Thus, in some embodiments, it is not necessary to remove multidirectional fan 100 from the drive shaft in order to adjust or change the position of blades 114. In certain embodiments, no tools are required to adjust or change the position of blades 114. Thus, in some embodiments, the position of blades 114 may be repositioned manually and without tools. The ability to manually adjust the position of blades 114 without tools and/or without having to remove multidirectional fan 100 from the drive shaft may save substantial amounts of time and manpower. Additionally, the capability of multidirectional fan 100 to operate as a bidirectional fan, a clockwise unidirectional fan, and/or a counterclockwise unidirectional fan may reduce the number of spare or replacement parts that must be kept in stock. For example, rather than swapping out a clockwise unidirectional fan for a counterclockwise unidirectional fan, which would require that both fans be in stock, multidirectional fan 100 is capable of operating as both clockwise unidirectional fan and counterclockwise unidirectional fan and thus only a single fan is necessary.

Although the present disclosure and its advantages have been described in detail, it should be understood that various changes, substitutions and alterations can be made herein without departing from the spirit and scope of the disclosure as defined by the following claims.

What is claimed is:

1. A multidirectional fan comprising:

a back plate having an interior surface and a central opening;

a hub located around the central opening and projecting from the interior surface of the back plate;

a plurality of flexible fan blades extending radially from the hub, wherein each flexible fan blade comprises a base and a blade, and wherein the base of each flexible fan blade is attached to the hub and the interior surface of the back plate; and a plurality of fasteners located at least partially on the interior surface of the back plate and configured to secure each flexible fan blade to the interior surface of the back plate in a plurality of fixed positions, said fixed positions comprising at least a radial bidirectional position.

2. The multidirectional fan of claim 1, wherein the back plate, the hub, the plurality of flexible fan blades, and the plurality of fasteners are molded as a single unit.

3. The multidirectional fan of claim 1, wherein the plurality of flexible fan blades are constructed from metal or plastic.

4. The multidirectional fan of claim 1, wherein the base of each flexible fan blade is removably attached to the hub and the interior surface of the back plate.

5. The multidirectional fan of claim 1, wherein each fastener comprises a plurality of mounts, and wherein each mount in the plurality of mounts corresponds to a different position in the plurality of fixed positions.

6. The multidirectional fan of claim 5, wherein the plurality of positions further comprise a clockwise unidirectional position and a counterclockwise unidirectional position.

7. The multidirectional fan of claim 5, wherein the plurality of mounts comprises a left detent, a central detent, and a right detent.

8. The multidirectional fan of claim 5, wherein the plurality of mounts comprises a plurality of holes located on the interior surface of the back plate and wherein each fastener further comprises a peg located on the blade of each flexible fan blade that is capable of being inserted into at least one hole in the plurality of holes.

9. A system comprising:

a multidirectional fan that comprises a back plate having an interior surface and a central opening, a hub located around the central opening and projecting from the interior surface of the back plate, a plurality of flexible fan blades extending radially from the hub, and a plurality of fasteners located at least partially on the interior surface of the back plate, wherein each flexible fan blade comprises a base and a blade, wherein the base of each flexible fan blade is secured to the hub and the interior surface of the back plate; and wherein each fastener is configured to secure each flexible fan blade to the interior surface of the back plate in a plurality of fixed positions, said fixed positions comprising at least a radial bidirectional position; and a device having a drive shaft, wherein the multidirectional fan is mounted on the drive shaft using the central opening in the back plate.

10. The system of claim 9, wherein each fastener is capable of securing the blade of at least one flexible fan blade in a plurality of positions, and wherein the multidirectional fan is capable of operating as a radial bidirectional fan, a clockwise unidirectional fan, or a counterclockwise unidirectional fan based on a position selected from the plurality of positions.

11. The system of claim 9, wherein the back plate, the hub, the plurality of flexible fan blades, and the plurality of fasteners are molded as a single unit.

12. The system of claim 9, wherein the base of each flexible fan blade is removably attached to the hub and the interior surface of the back plate.

13. The system of claim 9, wherein each fastener comprises a plurality of mounts, and wherein each mount in the plurality of mounts corresponds to a different position in the plurality of fixed positions.

14. The multidirectional fan of claim 13, wherein the plurality of positions further comprise a clockwise unidirectional position and a counterclockwise unidirectional position.

15. The system of claim 13, wherein the plurality of mounts comprises a left detent, a central detent, and a right detent.

16. A method comprising:

mounting a multidirectional fan onto a drive shaft, wherein the multidirectional fan comprises a back plate having an interior surface and a central opening, a hub located around the central opening and projecting from the interior surface of the back plate, and a plurality of flexible fan blades extending radially from the hub, and wherein each flexible fan blade comprises a base attached to the hub and the interior surface of the back plate and a blade positioned in a first fixed position; and repositioning the blade of each flexible fan blade to a second fixed position, wherein the first fixed position and the second fixed position are different positions selected from the group consisting of: a radial bidirectional position, a clockwise unidirectional position, and a counterclockwise unidirectional position.

17. The method of claim 16 further comprising rotating the drive shaft while the blade of each flexible fan blade is in the first position and rotating the drive shaft while the blade of each flexible fan blade is in the second fixed position.

18. The method of claim 16, wherein repositioning the blade of each flexible fan blade to the second fixed position is performed while the multidirectional fan is mounted on the drive shaft.

19. The method of claim 16, wherein repositioning the blade of each flexible fan blade to the second fixed position is performed manually and without tools.

20. The method of claim 16, wherein repositioning the blade of each flexible fan blade to the second fixed comprises moving the blade from a first mount of a fastener located on the interior surface of the back plate to a second mount of the fastener.

* * * * *